United States Patent [19]

Lowery

[11] 4,290,539

[45] Sep. 22, 1981

[54] BOOT TOOL

[76] Inventor: Robert L. Lowery, 2115 8th St., Vero Beach, Fla. 32960

[21] Appl. No.: 670,580

[22] Filed: Mar. 25, 1976

[51] Int. Cl.[3] ..... A47J 51/03

[52] U.S. Cl. ..... 223/118

[58] Field of Search ..... 223/118, 119, 111; 36/55.5

[56] References Cited

U.S. PATENT DOCUMENTS

| | | | |
|---|---|---|---|
| D. 224,365 | 7/1972 | Lewis | D2/378.2 |
| 1,163,399 | 12/1915 | Fox | 223/119 |
| 1,477,408 | 12/1923 | Williams | 223/118 |
| 1,710,138 | 4/1929 | Bartholomae | 223/118 |
| 2,366,097 | 12/1944 | Gesell | 223/118 |

FOREIGN PATENT DOCUMENTS

| | | | |
|---|---|---|---|
| 20308 | 1/1905 | Austria | 223/118 |
| 192541 | 11/1937 | Switzerland | 223/118 |

*Primary Examiner*—George H. Krizmanich

[57] ABSTRACT

A boot tool for a boot with a sheath height above the ankle and below the knee. A boot tool including a thin, tough, generally wide flexible thin plastic body with a long length in a longitudinal direction. The tool has a lower end that rests near the inside upper surface of the heel of a boot, a narrowing neck or collar portion adjacent the throat at a line drawn around the narrowest entry area into the foot portion of the boot, a long upper sheath portion that guides the heel of a foot through the sheath portion of the boot, and a top portion with a clip for attaching the boot tool to the top of the sheath.

3 Claims, 6 Drawing Figures

BOOT TOOL

BACKGROUND OF THE INVENTION

This is a new and improved boot tool having a thin, tough, generally wide flexible body including a lower end, a collar portion, a sheath portion and a top portion with connecting means.

In the past, boot users had to hold onto loops on either side of the upper rim of the sheath of the boot with their hands and push their foot into the boot by exerting great force. Many people, have trouble when they place their feet in boots, find that their feet bind the boot, or wrinkle the boot, such action gradually destroys the boot structure stitching and lining and reduces the life of the boot.

BRIEF DESCRIPTION OF THE INVENTION

A new and improved boot tool having a long, thin, generally wide flexible plastic body with a generally slick working side and a boot sheath contact side. The body has a relatively long length with a lower edge, a collar portion, and a sheath portion including a top portion. The lower edge of the boot tool is placed in or tucked into the heel socket to aid and support the boot tool for proper use. The collar portion is generally narrower than the width of the boot tool to provide a narrow chute for the heel of a user to move through the collar of the boot with minimum friction. The chute allows the instep of the foot of the user to be easily placed in the lower foot portion of the boot. The wide sheath portion tends to hold the sheath in an open position and allows the heel of a user to occupy a plurality of positions as it moves over the wide sheath portion as the foot of the user is moved through the narrow collar of the boot. The flexible body allows the body to conform to the varying shape of the boot sheath as the heel of a user is moved toward the heel of the boot over the upper rim of the stiff boot heel portion. The top portion extends above the top of the sheath of the boot for retrieval purposes. A connecting means in the top portion is used to clip the boot tool over the upper rim of the boot sheath to hold the boot tool in the rear of the boot against the sheath and the lower rim of the stiff boot heel portion.

It is an object of this invention to provide a boot tool to aid in placing one's foot into a boot having a sheath height above one's ankle and to provide protection to boot.

It is another object to provide a boot tool extending from the upper surface of the heel of a boot to a position above the upper rim of the boot sheath.

Another object of this invention is to provide a long, thin, generally wide flexible boot tool.

In accordance with these and other objects which will be apparent hereinafter, the instant invention will now be described with particular reference to the accompanying drawing.

DESCRIPTION OF A PREFERRED EMBODIMENT

Figure 1:
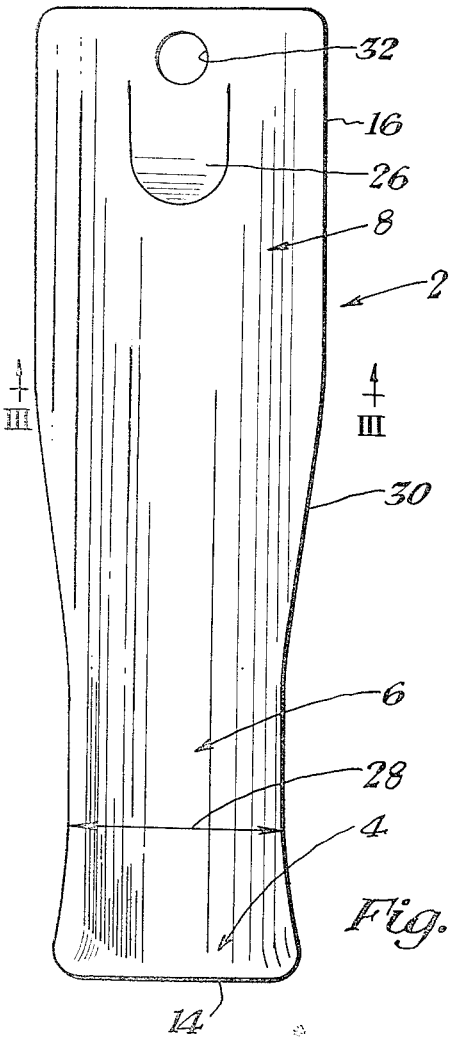
FIG. 1 is a forward view of the boot tool.
Figure 3:
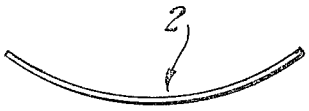
FIG. 3 is a top view of the boot tool shown in FIG. 1.
Figure 2:
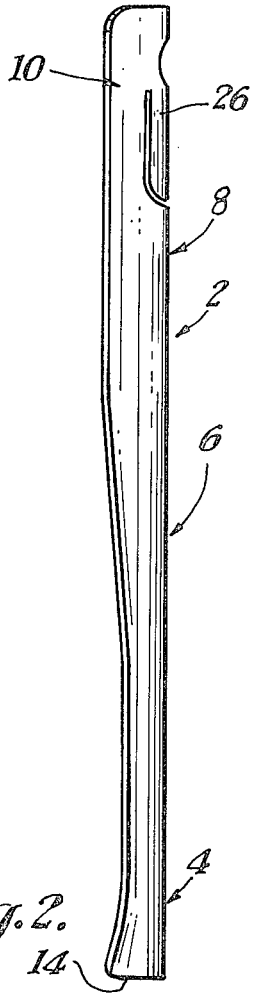
FIG. 2 is a side view of the boot tool shown in FIG. 1.
Figure 5:
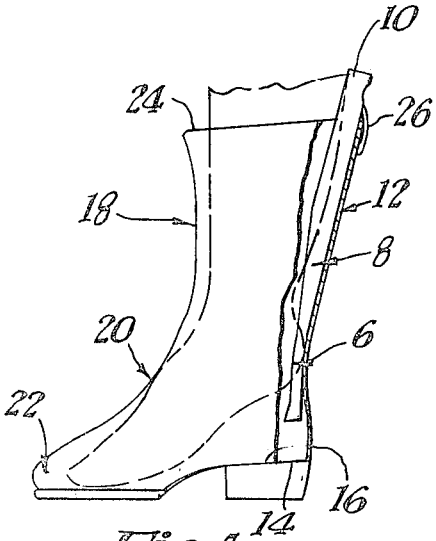
FIG. 5 is an illustration of placing a foot in a boot using the boot tool.

Referring now to the new and improved boot tool as shown in FIGS. 1, 2 & 3, the boot tool is generally designated by numeral 2 having a long, thin, generally wide flexible plastic body with a generally slick forward side, and a rear side, a portion of which is shown in FIGS. 2 and 3. The body includes a lower portion 4, collar portion 6, and a sheath portion 8 including a top portion 10. In use, the boot tool 2 is placed adjacent the rear portion of the boot sheath 12 as shown in FIG. 5, having its lower edge 14 near the upper inner surface of the heel 16 of a boot 18. The collar portion 6 of the boot tool 2 is positioned in the collar 20 of the boot, that is, the narrowest opening between the boot sheath 12 and the shoe portion 22 of the boot. The sheath portion 8 of the boot tool 2 has a relatively long length depending on the height of the boot sheath 12. The top portion 10 of the boot tool 2 extends above the upper rim 24 of the boot. The top portion 10 of the boot tool 2 includes a clip or connecting means 26. The clip portion may fit over the rim 24 of the boot 18 onto the outside portion of the boot sheath 12.

The lower portion 4 of the boot tool 2 provides lower edge 14 for positioning the boot tool in its "in use" position. The lower portion 4 has a width greater than the collar portion 6.

The collar portion 6 includes a narrow width, shown by numeral 28 in FIG. 1. The collar portion 6 is positioned in the collar portion 20 of a boot. The collar portion 6 is a generally narrow chute for positioning and directing the heel as it moves through the collar of the boot and as one's instep moves into the shoe portion of the boot. The chute of the collar portion 6 allows the foot to move easily into the foot portion of a boot. The sheath portion 8 varies in height depending on the height of the particular boot sheath. The side edges 30 between collar portion 6 and the widest sheath portion 8 may be tapered.

The top portion 10 may include connecting means of various types to connect the boot tool 2 to the sheath of a boot. A clip means 26 is illustrated in FIGS. 1 and 2. An opening 32 may be placed in the top portion that may aid in removal of the boot tool after it has been used to place a foot into the shoe portion of a boot.

The plast material to be used should be a flexible material normally between 0.014 inch to 0.045 inches in thickness. The boot tool may include a preset curve as shown in FIG. 3. The curve may be as great as a three-inch radius.

Figure 4:
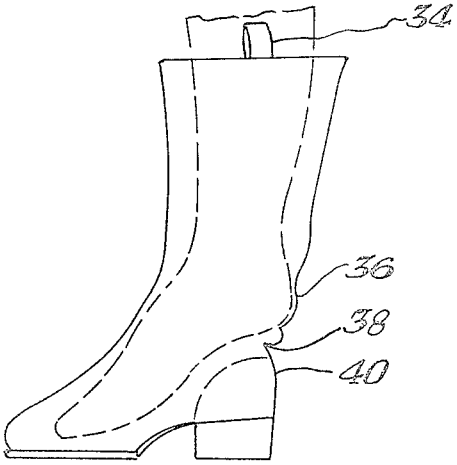
FIG. 4 is an illustration of placing a foot in a boot without a boot tool.

In the past when individuals tried to put on a boot, as shown in FIG. 4, loops on each side of the boot as shown at 34 would be held and one would push his foot into the boot. A normal occurance is to have the sheath portion shown by numeral 36 wrinkle up just above the upper rim portion 38 of the stiff boot heel portion 40. The wrinkling occurs just above the collar of the boot. This wrinkling, the pushing and the movement of the sheath at the upper rim portion 38 eventually wears the boot out or prematurely destroys the boot.

FIG. 5 illustrates the use of the boot tool to prevent deformation of the sheath.

Figure 6:
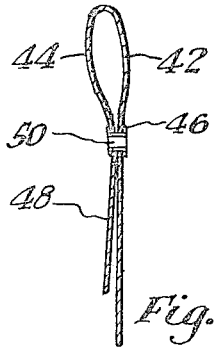
FIG. 6 is a cross section of an upper portion of another embodiment of the boot tool.

FIG. 6 shows an extention means 4*g* that is looped at 44 and includes connector 46 that connects portion 44 to the sheath portion 8. The lower distal end 48 may be used as a clip. The loop may be used to remove the boot tool from the boot as shown in FIG. 5. The fastener 46 may include an opening 50 to hang up the boot tool on a ply.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A boot tool for use in a boot with a long flexible sheath portion, a collar portion, an upper rim portion, a stiff heel portion and a lower heel all of which are connected together, the boot having a structure that extends from the top of said long flexible sheath portion, down through said collar portion of the boot and past said upper rim portion of said stiff heel portion of the boot, and ending near the upper inner surface of said lower heel of the boot, the boot tool comprising:

a single long generally uniform flexible body to allow conformity with the flexible portions of said boot, said body including a lower rear heel portion with a lower end, a narrower collar portion sized for positioning against only the rear of said collar portion of said boot, and a sheath portion with an upper end for placement in boots of varying heights, said sheath portion sized to extend between a position above the top of said long flexible sheath portion of said boot to a position near said upper inner surface of said lower heel of said boot, said body having a long longitudinal length for positioning it in boots with said lower end of said lower rear heel position near the top of said upper inner surface of said lower heel of said boot with the upper end of said sheath portion above the top rim of the boot, said narrow collar portion sized and shaped to be positioned between said long flexible sheath portion of said boot and said stiff heel portion of said boot for opening up said collar portion by a passing foot of a user to allow the instep and heel of the user's foot to pass easily through said collar portion and past said upper rim portion of said boot without damaging the boot structure between the lower portion of said long flexible sheath portion and said upper rim portion of said boot, said narrow collar portion flexing to form a heel chute and designed to also flex into the shape of the normal distorted lower portion of said long flexible sheath portion of said boot as the user's foot moves through said collar portion, and said narrow collar portion positionable between and in contact with the heel of the user and the rear portion of said stiff heel portion, said sheath portion connected to the said narrow collar portion for flexible use in contact along the inner length of said long flexible sheath of said boot, said sheath portion conforming with the movement of said long flexible sheath portion as the heel of the user passes over said long flexible sheath portion, and said sheath portion including a top portion connected near said upper end of said long flexible sheath portion of said boot for use over the top of said boot.

2. A boot tool as set forth in claim 1, wherein;

said top portion includes a connecting means in the form of a clip device for use in connecting said boot tool over the top of said boot to hold the boot tool in place when a user utilizes both his hands to grasp the sides of the sheath to pull the boot on over the user's foot.

3. A boot tool as set forth in claim 2 wherein;

said single body is made of a thin resilient sheet of material having a rear surface and a relatively slick front surface, and said body being between 0.14 and 0.45 of an inch thick.

* * * * *